US006491161B1

(12) United States Patent
Focke et al.

(10) Patent No.: US 6,491,161 B1
(45) Date of Patent: Dec. 10, 2002

(54) PACKAGE, ESPECIALLY FOR A GROUP OF CIGARETTE PACKS, PLUS METHOD AND DEVICE FOR MANUFACTURING SAME

(75) Inventors: Heinz Focke, Verden (DE); Hermann Blome, Blender-Einste (DE); Andreas Gümmer, Kirchlinteln-Hohenaverbergen (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/542,290

(22) Filed: Apr. 4, 2000

Related U.S. Application Data

(63) Continuation-in-part of application No. 09/266,823, filed on Mar. 12, 1999, now abandoned.

(30) Foreign Application Priority Data

Oct. 28, 1999 (EP) ..... 99121442

(51) Int. Cl.[7] ..... B65D 5/54; B65D 85/10

(52) U.S. Cl. ..... 206/264; 229/244

(58) Field of Search ..... 206/242, 256, 206/264, 265, 268, 271, 273; 229/243, 244

(56) References Cited

U.S. PATENT DOCUMENTS

| | | | | |
|---|---|---|---|---|
| 2,867,368 A | | 1/1959 | Kaplan | |
| 2,888,132 A | | 5/1959 | Guyer | |
| 3,141,602 A | | 7/1964 | Anderson | |
| 4,498,581 A | | 2/1985 | Dutcher | |
| 4,586,312 A | | 5/1986 | Limousin | |
| 5,357,734 A | * | 10/1994 | Focke et al. | 53/579 |

FOREIGN PATENT DOCUMENTS

| | | |
|---|---|---|
| DE | 35 06 541 | 10/1985 |
| DE | 42 00 921 | 7/1993 |
| DE | 93 11 792 | 1/1994 |
| DE | 295 19 134 | 3/1996 |
| DE | 196 48 242 | 5/1998 |
| EP | 137 334 | 9/1984 |
| EP | 454 541 | 10/1991 |
| WO | 95/21107 | 8/1995 |
| WO | 98 15405 | 4/1998 |

* cited by examiner

*Primary Examiner*—Jim Foster
(74) *Attorney, Agent, or Firm*—Sughrue Mion, PLLC

(57) ABSTRACT

Package for a group of cigarette packs which are surrounded by an outer wrapping (11) made of paper, foil, thin cardboard or the like. For easy opening of such a package for cigarette packs in particular, a perforated line (27) is formed in the region of a long side wall (17), specifically in the region of a separation plane (14) between subgroups of the cigarette packs (10).

2 Claims, 10 Drawing Sheets

25
14
22
20
11
28
18
14
10
10
16
21
17
14
27
19
17
12
28
13

PACKAGE, ESPECIALLY FOR A GROUP OF CIGARETTE PACKS, PLUS METHOD AND DEVICE FOR MANUFACTURING SAME

This is a Continuation-In-Part Application No. 09/266,823 filed Mar. 12, 1999 now abandoned.

BACKGROUND OF THE INVENTION

The invention relates to a (cuboid-shaped) package for a group of cigarette packs which is surrounded by an outer wrapper made of foldable packaging material such as paper, foil, thin cardboard.

Packages for cigarettes—so-called cigarette cartons—are large packages consisting of a plurality of individual cigarette packs. One very widespread type of package consists of ten cigarette packs which are divided into two rows. The cigarette packs of one row lie with their front or rear side against the cigarette packs of the adjacent row. The contents of the package so arranged are held together by an outer wrapper made of foldable packaging material, primarily paper or thin cardboard in the case of packages for cigarettes.

The ease of opening of such packages is in need of improvement, in particular for retailers in case the entire contents of the package is to be removed and, for example, inserted in a vending machine.

SUMMARY OF THE INVENTION

The object underlying the invention, therefore, is to provide a package of the type mentioned initially with an opening aid which when used makes the access to the package contents easier. In addition, the purpose underlying the invention is to propose a method and device which are suitable for the mechanical attachment of the opening aid to the package.

In achieving this stated object the package according to the invention is characterized by the following features:

a) the group of cigarette packs is surrounded on all sides by the outer wrapper, b) the cigarette packs are arranged in (two) rows of packs in such a way that a continuous separation plane is formed between the two rows of packs, c) the separation plane extends in the region of side walls of the outer wrapper, d) the side wall exhibits a weakened line, in particular a perforated line, e) the weakened or perforated line extends in the region of the separation plane of the pack rows (approximately) along the full length of the side wall.

A package of the preferred embodiment has an extended cuboid-shaped form, with a large-surface front and rear side, narrow long side walls and with small end walls formed by folding. According to the invention, the perforated line extends along at least one of the side walls, with said wall exclusively exhibiting the perforated line which runs in the longitudinal direction of the side wall.

The perforated line ensures quick and easy access to the total contents of the package. The perforated line can be split along its full length by manual intervention. Thus the total contents of the package are immediately exposed for removal.

The method according to the invention is such that a continuous web of material for the outer wrapper is provided with transversely-directed weakened or perforated lines, which preferably are centered on the material web and end at a distance from the side edges of the material web, and that following the correctly positioned application of the weakened or perforated line the blanks are severed from the material web.

The device according to the invention for the manufacture of packs or blanks for the outer wrapper is equipped with a perforation tool arranged in the region of a perforation station which applies the perforated line, specifically during a temporary standstill phase of the material web, either by means of a perforation tool which can be moved back and forth transversely to the material web or by means of a perforation blade, which applies the complete perforated line in a single working stroke.

BRIEF DESCRIPTION OF THE DRAWINGS

Further details of the invention are explained more fully below with the aid of an exemplary embodiment of the pack and the device. The drawings show.

DETAILED DESCRIPTION OF THE INVENTION

Figure 1:
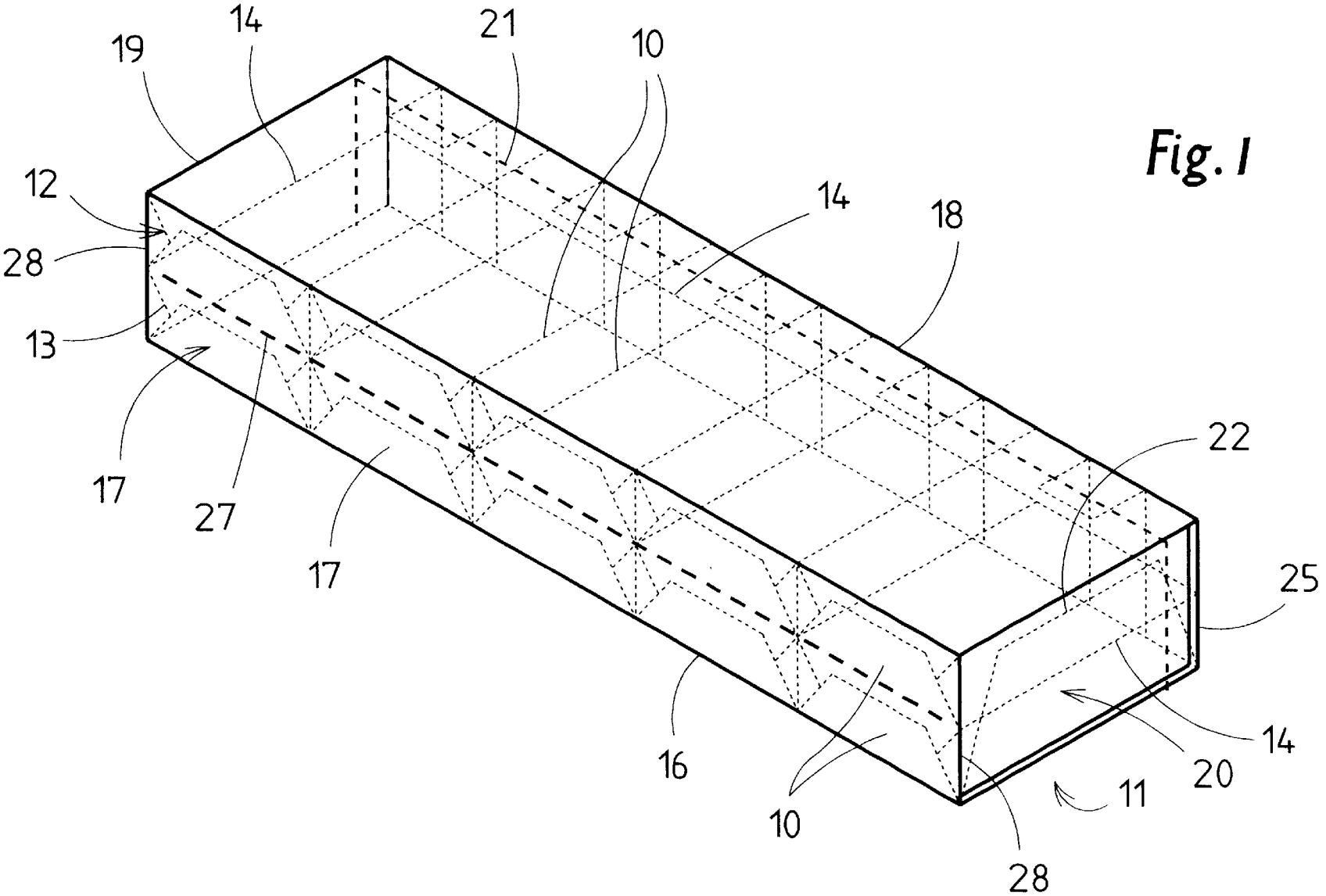
FIG. 1 a package for cigarettes in perspective view.

The drawings relate to packages for a group of cigarette packs 10. A plurality of cigarette packs 10, in the present case ten, are formed into an ordered group and surrounded by an outer wrapping 11. The latter consists expediently of (layered) paper, but can also be manufactured from other suitable packaging materials.

The packaging unit has an extended cuboid-shaped form. This geometric shape arises from the arrangement of the cigarette packs 10 in two rows of packs 12, 13 each having five cigarette packs 10. The cigarette packs 10 lie with their large-area sides, i.e. front side and rear side, against one another. In the region of a central longitudinal plane of the packaging unit, a continuous separation plane 14 arises between the two pack rows 12, 13.

The group of cigarette packs 10 is completely surrounded by the outer wrapping 11. The latter consists therefore of a front wall 15 and an opposite rear wall 16 with narrow long side walls 17, 18 arranged between the same, and of end walls 19, 20 likewise facing one another. In the exemplary embodiment according to FIG. 1 and 2, the blank for the outer wrapping 11 is configured such that a marginal front wall 15 is joined to the side wall 18 by means of an opposite edge strip 21. The edge strip is connected to an inner side of the front wall 15 by gluing.

Figure 2:
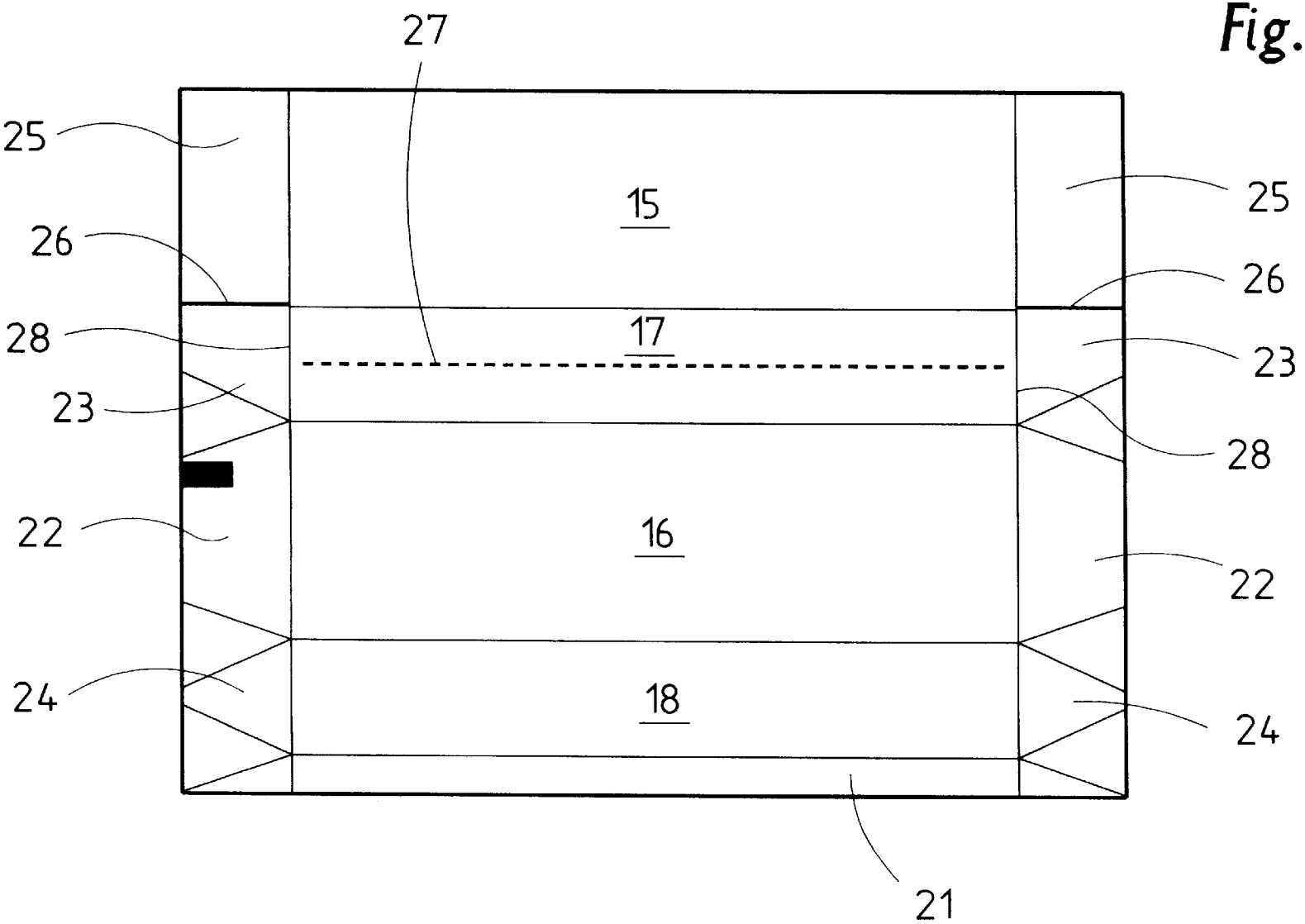
FIG. 2 a spread-out blank for an outer wrapping of a package according to FIG. 1, FIG. 3 another embodiment of a package for cigarettes in perspective view, FIG. 4 a partial cross-section of the package according to FIG. 1, on an enlarged scale, FIG. 5 a spread-out blank for an outer wrapping of a package according to FIG. 2 and FIG. 3, FIG. 6 a device for applying a perforated line in the region of a material web, in schematic side view, FIG. 7 a detail of the device according to FIG. 6, namely an assembly for applying the perforated line, in cross-sectional view, FIG. 8 a further detail of the device according to FIG. 6, on an enlarged scale, FIG. 9 a detail from FIG. 8 on a further enlarged scale (Detail VI), FIG. 10 a detail of the device with another exemplary embodiment of a perforation assembly, in side view, FIG. 11 longitudinal section of the perforation assembly, namely in a sectional plane VIII—VIII of FIG. 10, FIG. 12 cross-sectional view through the perforation assembly in sectional plane IX—IX of FIG. 11, FIG. 13 a detail of the perforation assembly in its perforation position, on an enlarged scale, FIG. 14 a detail of FIG. 13, viewed in a transverse sectional plane.
Figure 4:
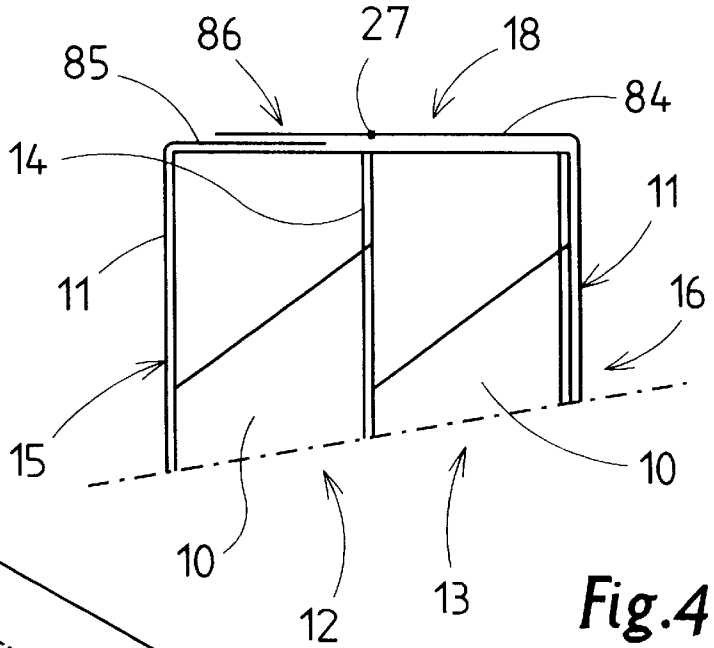
Figure 3:
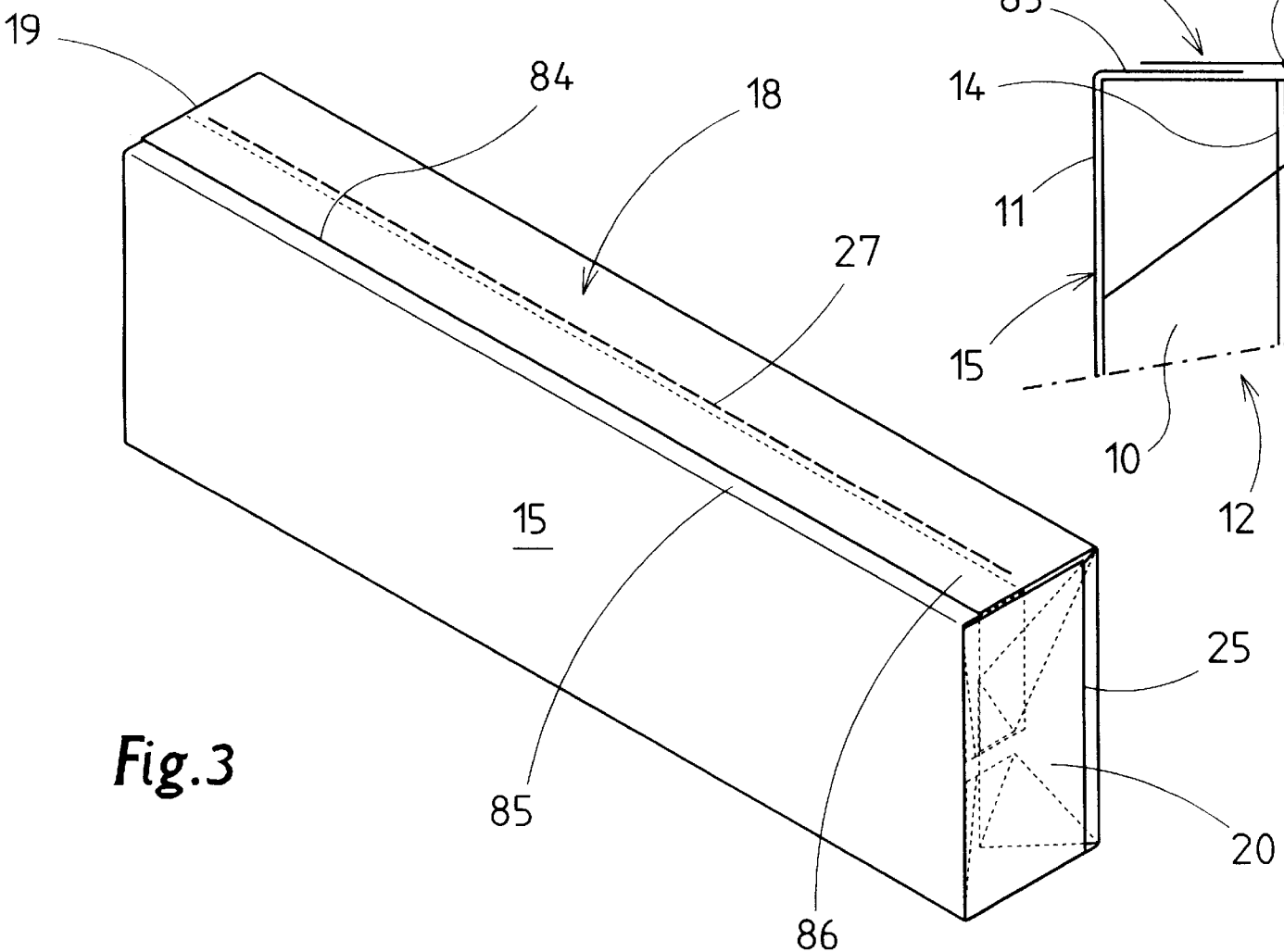
Figure 5:
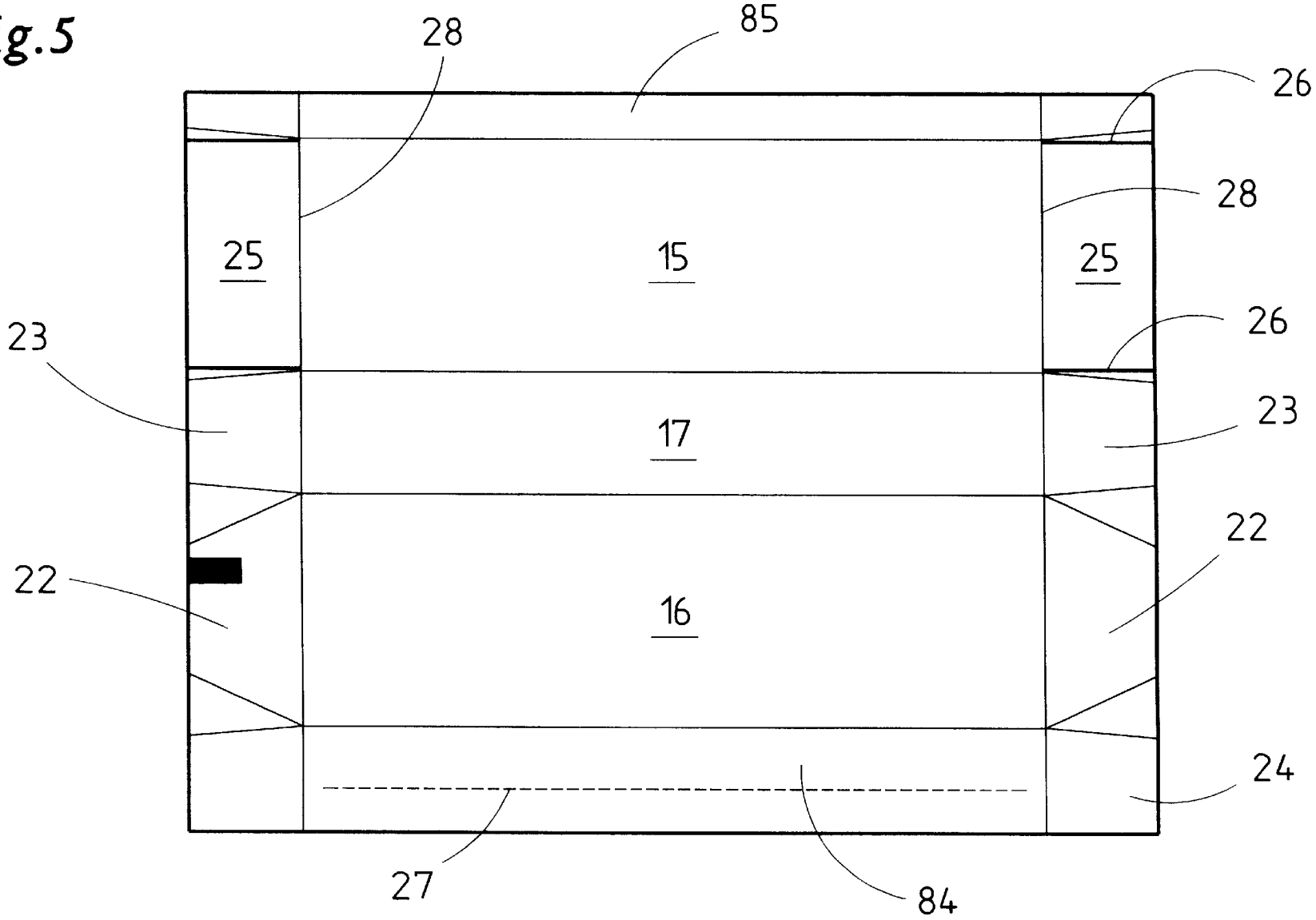

On the exemplary embodiment according to FIG. 3 to FIG. 5, the blank of the outer wrapping is configured in a slightly different fashion. Here the side wall 18 is comprised of partially overlapping marginal folding flaps, namely an outer edge strip 84 and an inner edge strip 85. The outer, broader edge strip 84 is connected to the rear wall 16, and the inner, narrower edge strip 85 is connected to the front wall 15. In the finished package (FIG. 2, FIG. 3), the inner edge strip 85 is almost completely covered by the outer edge strip 84. The outer edge strip 84 has almost the same width as side wall 18. In the region of an overlap 86 of the edge strips 84, 95, the latter are joined to each other by adhesive bonding (or by thermal sealing). The overlap 86 is positioned off-center, specifically offset to the separation plane 14.

The end walls 19, 20 in both exemplary embodiments consist of a plurality of folding flaps, namely of trapezoid inner flap 22, of likewise trapezoid side flaps 23, 24 and of a top flap 25. The latter is configured rectangular and completely covers the end wall 19, 20 as an outer flap. To this end, the top flap 25 is separated from the adjacent side flap 23 by a punched-out line 26.

The packages or their outer wrapper 11 is provided with an opening aid for the outer wrapper in the region of at least one of the package walls, specifically in the region of the long side wall 17. This opening aid comprises a weakened line which can be easily split, preferably a perforated line 27 in the outer wrapping. The perforated line 27 extends approximately at the halfway point, i.e. along an (imaginary) longitudinal center line of the side wall 17 or 18. It is important that the perforated line 27 runs as an opening aid at least approximately in the region of the separation plane between partial groups of the cigarette packs 10. In this way, when the perforated line 27 is split, i.e. the outer wrapping is opened, direct access is provided to the entire package contents. The process of (manually) opening or splitting the perforated line 27 is made easier with this positioning. The perforated line 27 extends in the present case over almost the entire length of the side wall 17 or 18 and ends at a small distance from upright package ends 28.

On the exemplary embodiment according to FIG. 1 and 2, the continuous, straight perforation line 27 is positioned in the region of the single-piece side wall 17. An alternative to this is shown in FIG. 3 to 5. Here the perforation line is arranged in the region of the side wall 18 formed by the edge strips 85, 85 and centered thereon, namely along the separation plane 14. The overlap 86 lies entirely adjacent to the perforation line 27. The blank (FIG. 5) is configured such that the perforation line 27 runs within the marginal edge strip 84 at a suitable distance from the free edge of the blank.

The perforated line 27 is applied mechanically, specifically in the process of manufacturing the package. The perforated line is already applied to a material web 29 from which blanks for the outer wrapping 11 are to be manufactured.

To this end the material web 29 is drawn from a reel (not shown) and led through a perforation unit 30. Thereafter, the blank provided with the perforated line 27 is severed from the material web 29 by a cutting unit 31. The blank can then be further processed in conventional fashion in a packaging machine to form the outer wrapping 11.

Arranged upstream of the perforation unit 30 is a pendulum 32, which is known in principle, with fixed and movable deflection rollers 33. The pendulum 32 determines by its relative position the tension in the material web 29 or compensates for fluctuations in tension until the unit is switched off when a critical web tension is exceed or not reached.

The material web 29 is deflected into a horizontal plane via a fixed guide roller 34 in the region of the perforation unit 30. A likewise fixed counter roller 35 cooperates with this guide roller 34. The material web is conveyed between guide roller 34 and counter roller 35, forming a horizontal web section 36.

In the region of this web section 36 the perforated line 27 is applied transverse to the longitudinal extension of the material web 29, specifically in an approximate centered position, i.e. with approximately the same distances to the side edges of the material web corresponding to the width of folding flaps 22 . . . 25. The perforated line 27 is applied during a temporary standstill of the material web, which is conveyed in phases, by a perforation unit.

On the exemplary embodiment according to FIG. 6 to FIG. 9, the perforation unit employed as the perforation tool exhibits a perforation disc 37 moved in rotation.

Said disc is attached to a shaft 38 which is connected in turn to a driving wheel, namely a toothed wheel 39. The unit comprising perforation disc 37, shaft 38, toothed wheel 39 and other members can be moved transversely to the material web 29 to produce the perforated line 27. In the process, the toothed wheel 37, runs down a fixed transverse rack 40 in such a way that, through mutual engagement, the toothed wheel 39, and with it the perforation disc 37, carries out an exact rotation during the transverse movement. The dimensions are in the present case chosen to be such that the diameter of the perforation disc 39 corresponds to the diameter of the toothed wheel 39 or of the equator of same. In this way, perforation disc 37 and toothed wheel 39 carry out exactly corresponding rotary movements.

Perforation disc 37 and toothed wheel 39 may be moved by a fixed pressure means cylinder 41 running in the direction of movement of the members mentioned. Here, this is a pressure means cylinder 41 with no piston rod. A driver 42 protrudes laterally from the housing of the pressure means cylinder 41 and is connected to the unit which can be moved backwards and forwards. Pressure can be applied in both directions to the pressure means cylinder 41 or to a piston which can move in same. The piston (not shown) is connected to the driver 42.

The perforation disc 37 and the toothed wheel 39 are connected via the shaft 38 with a carrier 43 which is configured as a slide 44 in the upper region. The latter slides on a long profile rail 45 which, for its part, is fastened to the underside of the pressure means cylinder 41. A connecting piece 46 is connected on the one hand to the driver 42 of the pressure means cylinder 41 and on the other hand to the movable unit, namely the carrier 43 or the slide 44. The backward and forward movements of the driver 42 are thus transmitted to the carrier 43. The rotating shaft 38 is held in a bearing 47 with roller bodies in the carrier 43.

The perforation disc 37 is equipped along its perimeter with projecting tooth-like perforation blades 48 between which gaps or notches are formed. Each perforation blade 48 carries out one incision of the perforated line 47 in the material web 29.

The perforation disc 37 is of such dimensions and so designed that for each movement cycle, i.e. in one rotation, a complete perforated line 27 is created. In order to maintain the correct length of this line, the effective perimeter of the perforation disc 37 is limited with respect to the arrangement of the perforation blades 46. On the present exemplary embodiment one section of the perforation disc 37 is missing. A transverse border edge 49 joins ends of a partial perimeter of the perforation disc 37 creating the perforation. Perforation blades 48 are accordingly arranged along the whole circular partial perimeter, namely from one end of the border edge 49 to the other end. The perforated line 27 is therefore correctly delimited by the preset length of the perimeter with perforation blades, independently of the length of the movement path of the perforation disc 37 as it rotates.

Figure 7:
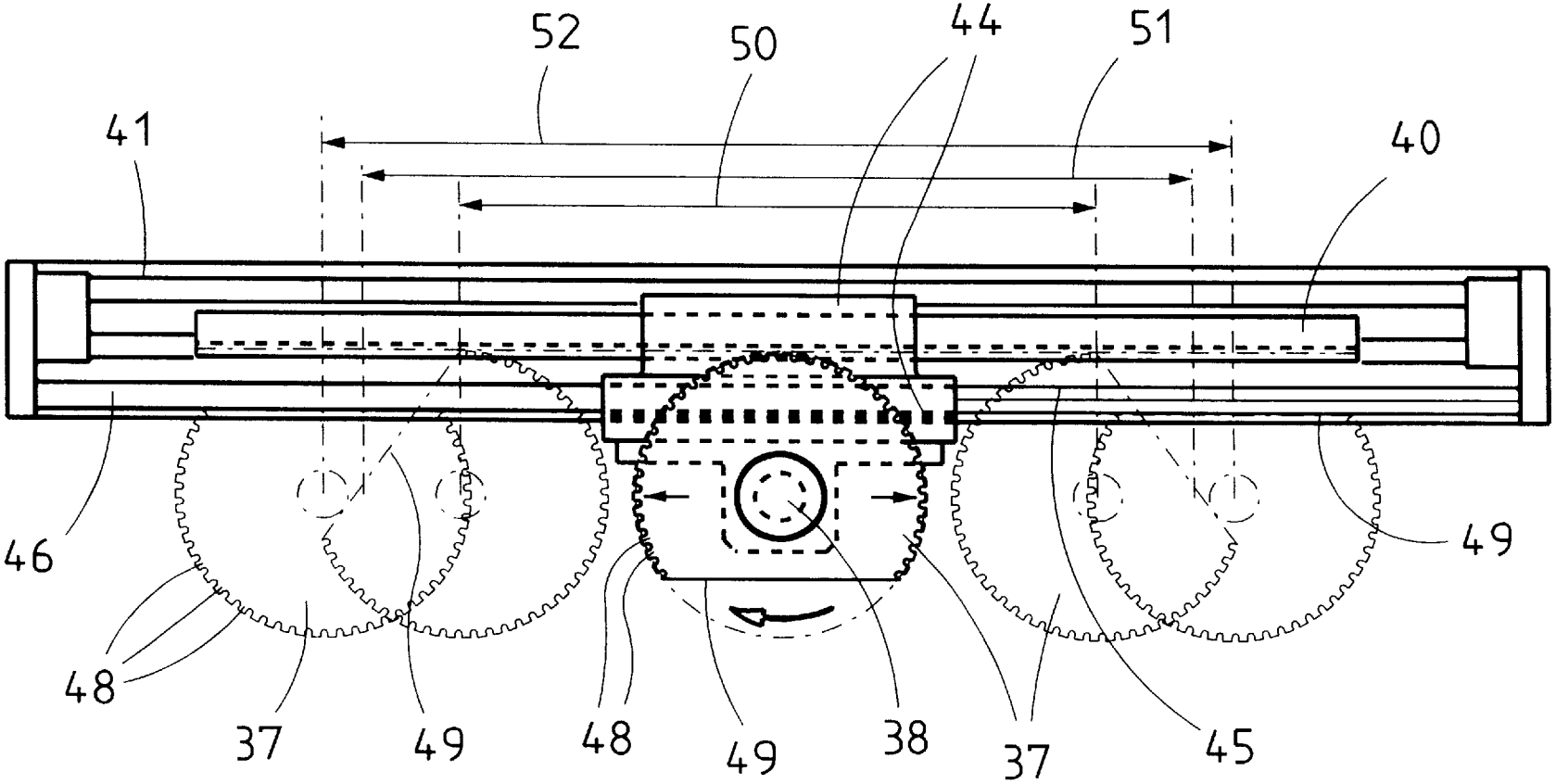
Figures 8, 9:
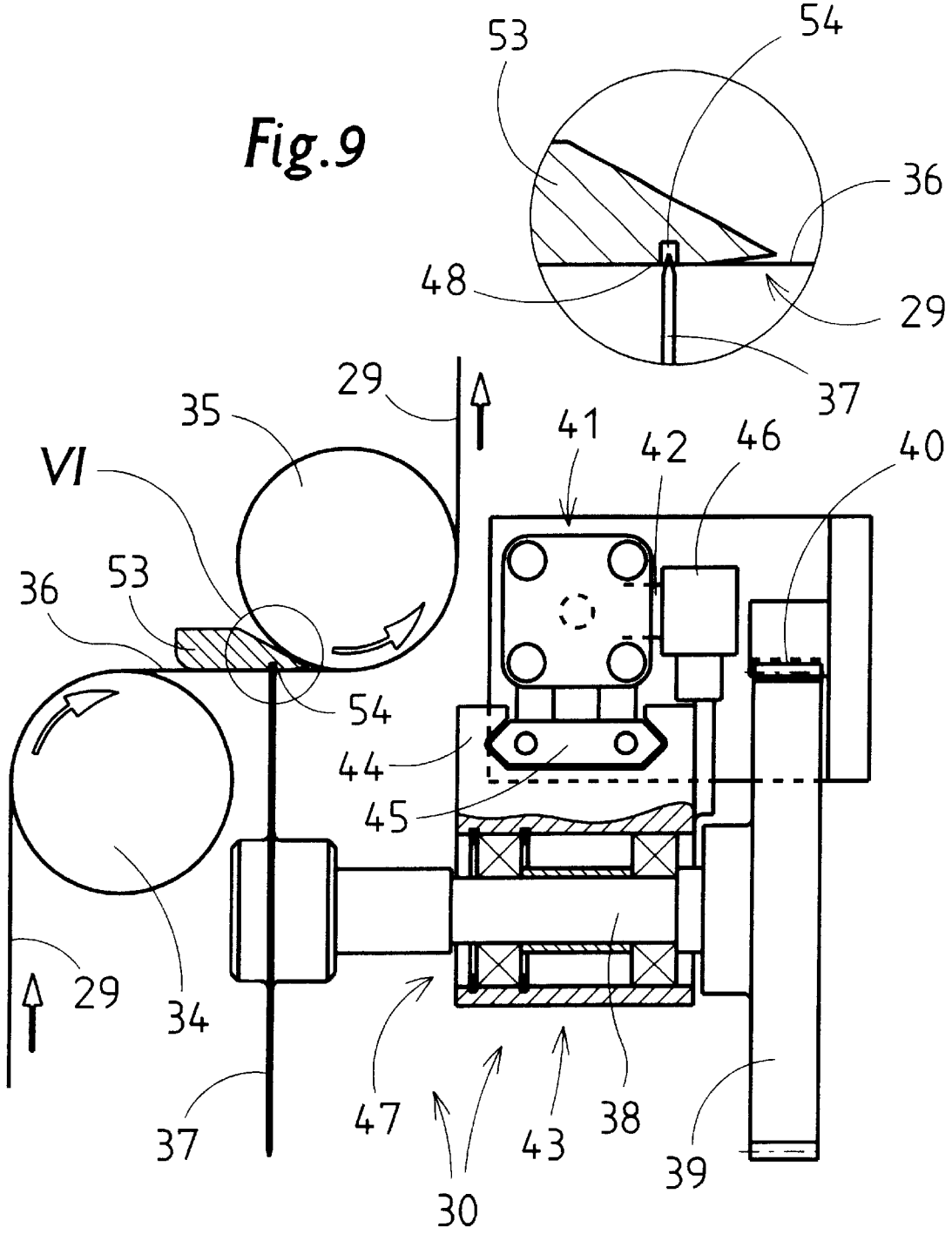
Figure 10:
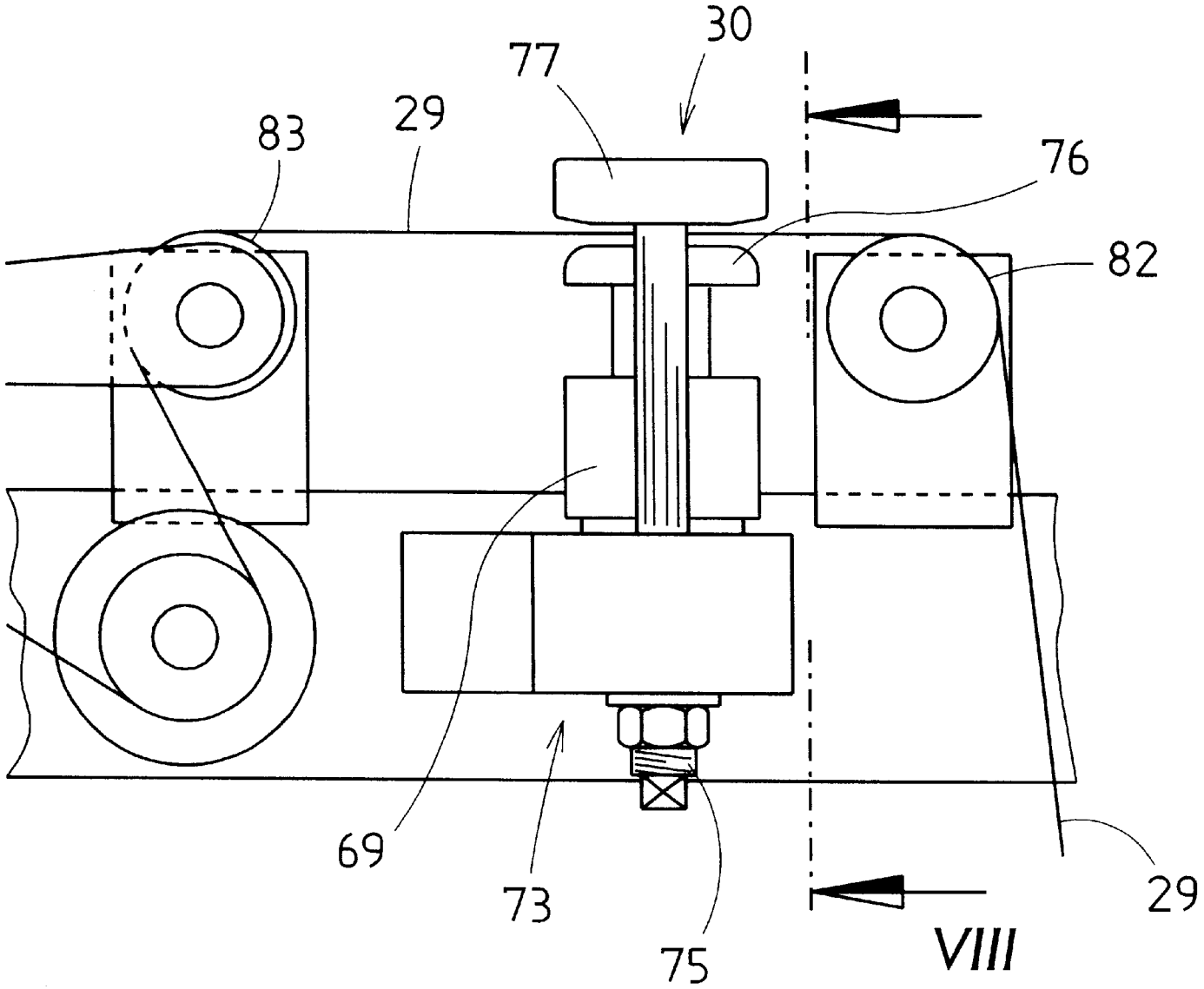

This effective perimeter length of the perforation disc 37 corresponds to a length 50 of the perforated line 27 in the material web 29. Its width 51 is significantly larger. The movement path 52 of the perforation disc 37 or of the shaft 38 extends beyond the width 51 of the material web 29 (FIG. 7). The respective end position of the perforation disc 37 is thus chosen to be such that during the momentary standstill of the perforation disc 37 the material web 29 can be moved further on to one of the end positions without being damaged by the perforation disc 37. On the shown exemplary embodiment, the border edge 49 is aligned parallel to the material web 29, at a clear spacing from same.

During the application of the perforated line 27, the material web 29 is held on or against a flat support. This is a horizontal, strip-shaped supporting plate 53. Web section 36 lies against this supporting plate 53, against the underside of same. In the effective region of the perforation disc or of the perforation blades 48, the supporting plate 53 is provided with a narrow groove 54 running in the longitudinal direction.

The material web 29, provided with the perforated line 27 in the region of the perforation unit 30, is guided after the counter roller 35 over an adjusting roller 55. The latter is arranged so as to be movable along a transverse axis, for example in an elongated hole. The relative position of the adjusting roller 55 can be set in this way, to adapt to different lengths of the blanks for the outer wrapping 11 which are to be manufactured, depending on the size of the package.

After the adjusting roller 55, the material web 29 is guided over additional rollers. These include a pair of braking rollers 56, 57. The latter are equipped with a free-wheel acting on one side and can therefore rotate in one direction only. The braking rollers 56, 57 prevent the material web 29 from running back once a blank for the outer wrapping 11 has been separated from it.

The material web 29 is deflected upwards by the braking roller 57, forming an upright web section 58. Located in the region of same is the cutting unit 31. It consists of a blade 59, which can be moved transversely, and a fixed counter-blade 60. The movable blade is connected to an actuating mechanism 61 which causes a backward-and-forward transverse movement of the blade 59 to carry out the severance cut.

Preliminary rollers 62, 63 are arranged in front of the cutting unit 31 or the blades 59, 60. These rollers draw the material web 29 forward to correspond exactly with the length of a blank for the outer wrapper 11. The preliminary rollers 62, 63 can be controlled by a printed mark reader (not shown), which detects printed marks on the material web 29.

The perforation unit 30 and the cutting unit 31 are arranged at a fixed, exact spacing from one another which corresponds to the length, or if required, the multiple length, of the blank for the outer wrapping 11 plus the distance from the edge of a further blank to the perforated line 27. What matters is that severance cuts for the outer wrapping 11 are executed at an exact distance from the perforated line, in such a way that the latter is located in the described position in the region of the finished package.

The perforation unit 30 shown in FIG. 10 to FIG. 14 is particularly advantageous due to its efficiency. In this perforation unit 30 the complete perforated line 27 is created in a single working stroke. To achieve this, the perforation unit is equipped with a perforation blade 64 as the perforation tool. This has a serrated cutter with triangular blade tips 65. Arranged at an angle to each other, the cutting edges 66 of the blade tips 65 are sharpened on both sides. The cutting edges 66 are each arranged at an acute angle to one another.

Each blade tip 65 executes a punched cut in the material web or in the blank as part of the continuous perforated line 27. The length of the punched cut is determined by the penetration depth of the blade tip 65. Accordingly, the perforation blade 64 is moved against the material during the working stroke that the blade tips 65 penetrate the material web 29 only in a partial area, thus creating a continuous row of punched cuts. The movement of the perforation blade 64 is therefore limited, specifically by limit stops. The length of the perforation blade 64 corresponds to the length of the perforated line 27.

The perforation blade 64 is attached to a mounting which can be moved up and down in the perforation unit 30, namely to a lifting carriage 67. The latter is arranged below the plane of the material web 29. The perforation blade 64 with its upward-directed blade tips 65 is thus moved against the material web 29 from below, specifically by virtue of the upward movement of the lifting carriage 67. The latter can be slid along the lateral guide rods 68. For actuating the lifting carriage 67 and thus the perforation blade 64 a short-stroke actuating cylinder 69 with a nonrevolving piston rod (not shown) is employed. The actuation cylinder 69 is arranged below the lifting carriage 67, and centered approximately to it.

The perforation blade 64 is anchored on the upper side of the long-extended lifting carriage 67. The relatively thin-walled perforation blade 64 is seated in a rod-shaped mount, namely in a elongated supporting piece 70. The perforation blade 64 projects out of the top of the supporting piece 70. The latter in turn is mounted in a depression of the lifting carriage 67 and fixed to same by means of anchoring bolts 71. The anchoring bolts in turn are seated in bore holes 72 having a large diameter so that the relative positioning of the perforation blade 64 or the supporting piece 70 can be altered in the longitudinal direction of the lifting carriage 67.

The lifting carriage 67 or the actuation cylinder 69 is stayed (below) on a base 73, which is releasably connected to the machine frame. The actuation cylinder 69 is adjustably supported in an approximately centered depression of the base 73, namely with an adjusting bolt 74. The latter can be adjusted on the underside of the base 73 with an appropriate tool and with the aid of an adjusting screw 75. The penetration depth of the perforation blade 64 in the material web 29 can be set with the aid of the adjusting screw 75 and the adjusting bolt 74 via the actuation cylinder 69, with the actuation cylinder executing a firm, preset lifting motion.

The guide rods 68 for the lifting carriage 67 are likewise anchored on the base 73.

During the perforation cut the material web 29 or the blank is held in place by the perforation blade 64, specifically by it being pinched between large surface clamping members. The latter comprise on one hand a lower clamping plate 76 below the material web 29 and a counter clamping plate 77 on the opposite, or upper, side of the material web 29. The counter clamping plate 77 is fixedly arranged by being connected to the guide rods 68. The (lower) clamping plate 76 can be moved up and down. A perforation cut is executed by having the material web 29 pressed against the lower side of the counter clamping plate 77 through the upward movement of the clamping plate 76 in the region of the perforation blade 64.

The clamping plate 76 can be moved up an down with the perforation blade 64 and for this purpose it is mounted on the lifting carriage 67. The clamping plate 76 is connected in an elastically movable manner to the lifting carriage 67 in such a way that during the upward movement of the lifting carriage the clamping plate 76 is first pressed against the material web 29 or against the counter clamping plate 77 and afterwards, during the continued upward movement of the lifting carriage 67, the perforation blade 64 is moved further upward to a position according to FIG. 13 or FIG. 14 in order to execute the perforation cut.

Figure 11:
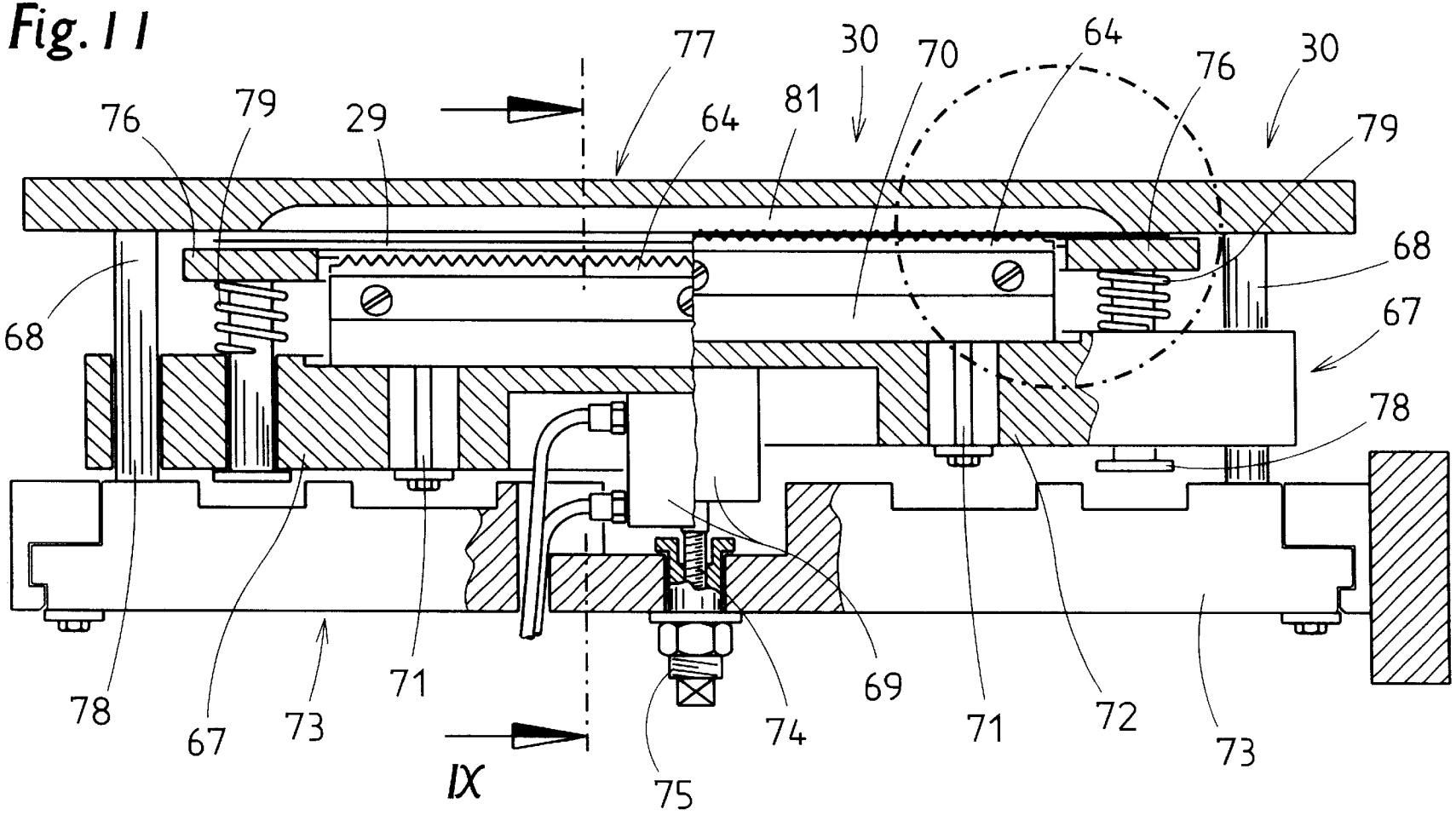
Figure 13:
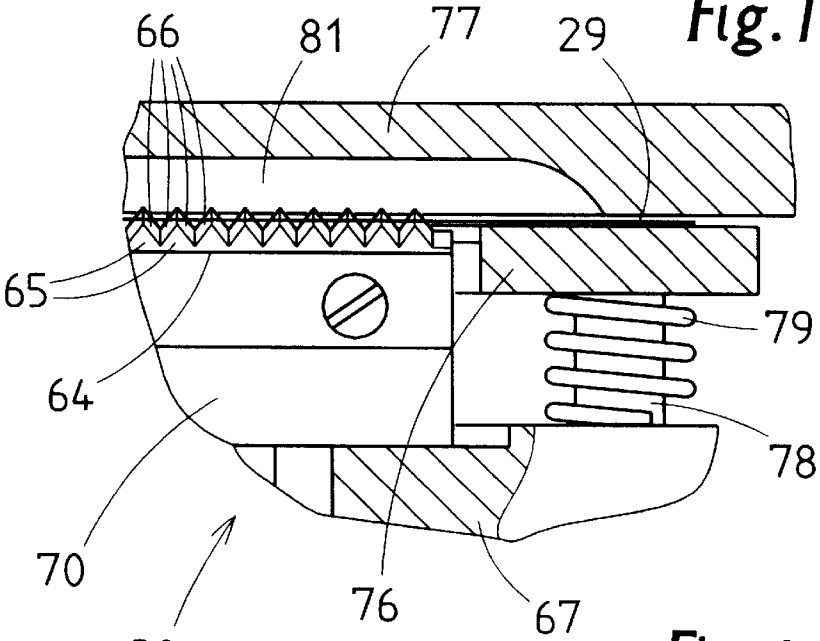
Figure 14:
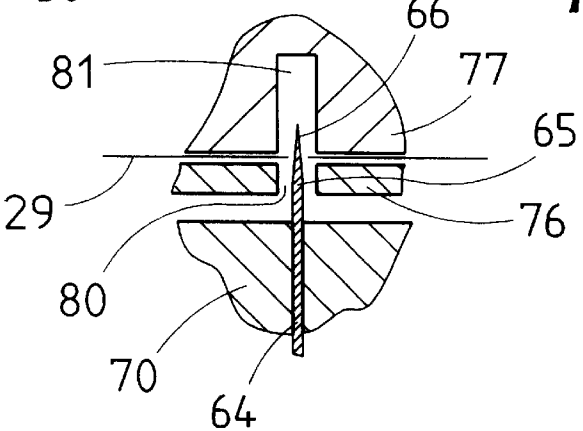
Figure 12:
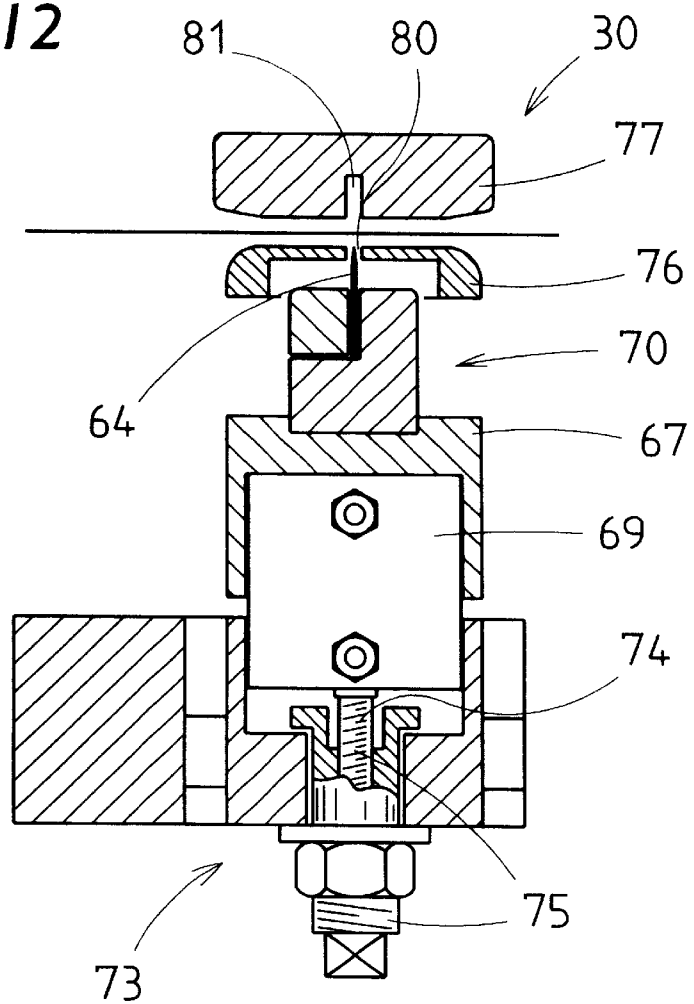

For this purpose, the clamping plate 76 is connected to the lifting carriage 67 by means of load-bearing bolts 78. The load-bearing bolts 78 are disposably seated in bore holes of the lifting carriage 67. The clamping plate 76 is supported on the lifting carriage 67 by springs 79 in an elastically disposable manner. A spiral spring 79 surrounds each loadbearing bolt 78. During the upward movement of the Lifting carriage 67 the springs 79 are pressed together until the upper final position of the lifting carriages 67 is reached (FIG. 11, right).

In order that the perforation blade 64 can freely execute the perforation cut in the stayed material web 29 or in the blank, the clamping plate 76 is provided with a slit 80 running in the longitudinal direction through which the perforation blade 64 or the blade tips 65 can pass through. On the opposite side the counter clamping plate 77 is provided with a narrow groove 81 running in the longitudinal direction, into which the areas of the blade tips 65 passing through the material web 29 can enter.

Figure 6:
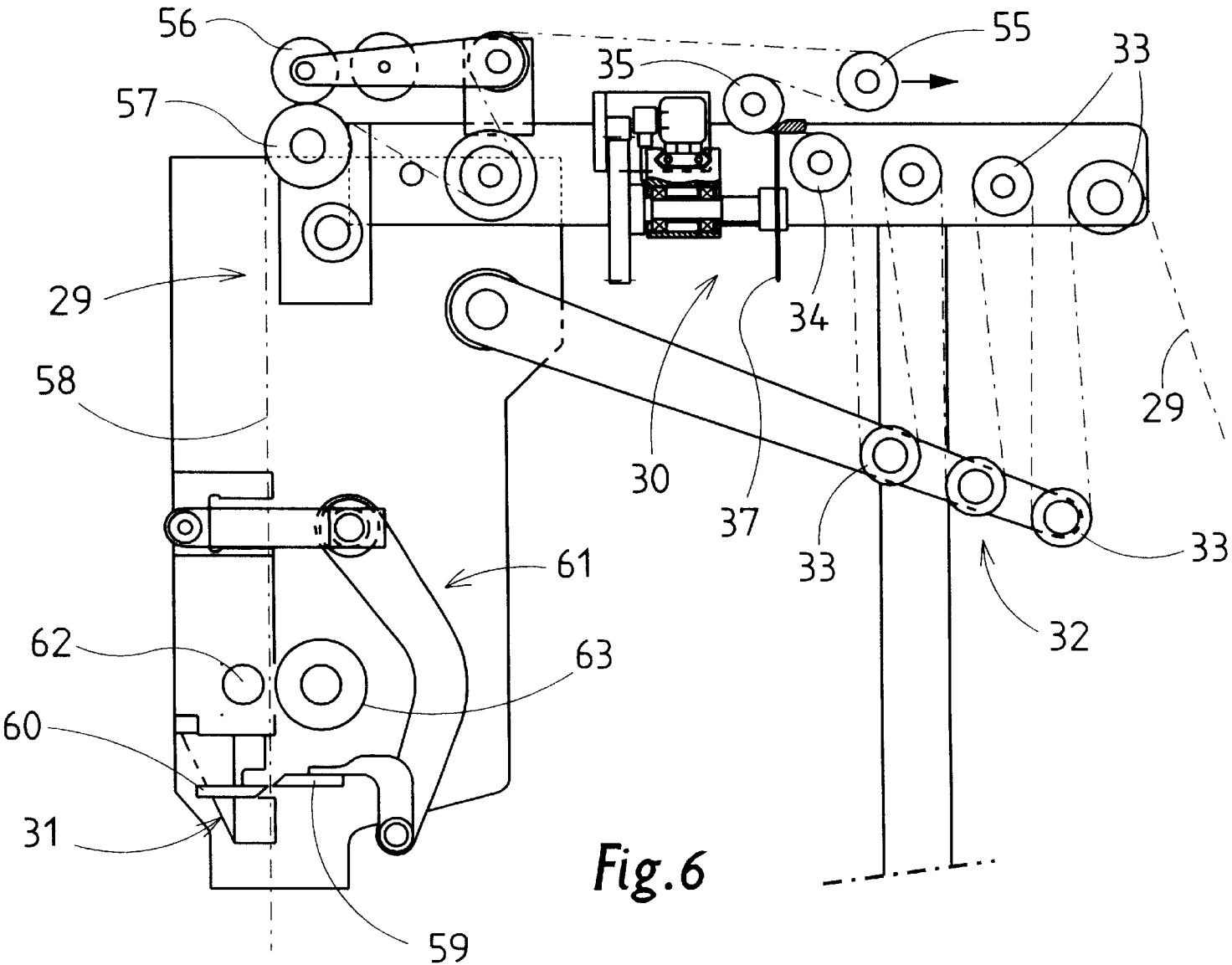

After passing through the perforation unit 30 with this configuration, the material web 29—analogous to the exemplary embodiment of FIG. 6—is then fed over the deflection roller 82 on a pendulum 32. On the opposite (exit) side there follows a further deflector roller 83, which feeds the material web 29 (provided with perforated line 27) to the cutting unit 31.

List of Designations

10 cigarette pack
11 outer wrapping
12 row of packs
13 row of packs
14 separation plane
15 front wall
16 rear wall
17 side wall
18 side wall
19 end wall
20 end wall
21 edge strip
22 inner flap
23 side flap
24 side flap
25 top flap
26 punched-out line
27 perforated line
28 package edge
29 material web
30 perforation unit
31 cutting unit
32 pendulum
33 deflection roller
34 guide roller
35 counter roller
36 web section
37 perforation disc
38 shaft
39 toothed wheel
40 transverse rack
41 pressure means cylinder
42 driver
43 carrier
44 slide
45 profile rail
46 connecting piece
47 bearing
48 perforation blade
49 border edge
50 length
51 width
52 movement path
53 supporting plate
54 groove
55 adjusting roller
56 braking rollers
57 braking rollers
58 web section
59 blade
60 counter-blade
61 actuating mechanism
62 preliminary roller
63 preliminary roller
64 perforation blade
65 blade tip
66 cutting edge
67 lifting carriage
68 guide rods
69 actuation cylinder
70 supporting piece
71 anchoring bolts
72 bore hole
73 base
74 adjusting bolt
75 adjusting screw
76 clamping plate
77 counter clamping plate
78 load-bearing bolts
79 spring

80 slit

81 groove

82 deflection roller

83 deflection roller

84 edge strip (outer)

85 edge strip (inner)

86 overlap

What is claimed is:

1. A bundle pack comprising a group of cigarette packs (10) which is surrounded by an outer wrapping (11) of foldable packaging material, the outer wrapping forming long, stretched-out longitudinal walls, namely a front wall (15), a rear wall (16) and first and second narrow side walls (17, 18), as well as end faces formed by folding flaps, wherein:

a) said long, stretched-out first narrow side wall has only one substantially straight perforation line (27) along which the outer wrapping (11) is splitable to open the bundle pack and provide access to the cigarette packs;

b) the perforation line (27) extends in only the first narrow side wall, in the longitudinal direction thereof, and continuously over approximately the entire length thereof;

c) the perforation line (27) is arranged approximately in the longitudinal center of the first narrow side wall, namely in a separation plane (14) formed by two rows (12, 13) of the cigarette packs (10); and d) the perforation line (27) divides the first narrow side wall into two closed side wall sections which are separable from one another by the perforation line (27) and which are free of any other perforation lines.

2. The bundle pack according to claim 1, wherein:

a) the first narrow side wall comprises two partially overlapping folding tabs, namely outer and inner edge strips (84, 85) of the outer wrapping (11), the edge strips (84, 85) being connected to one another by glue in a region of overlap (86) of the edge strips;

b) the outer edge strip (84) across substantially the entire length of the first narrow side wall; and c) the perforation line (27) is in the outer edge strip (84) and runs outside of a region of or next to the overlap (86) of the two edge strips (84, 85).

* * * * *